US007252253B2

(12) United States Patent
Biswas et al.

(10) Patent No.: US 7,252,253 B2
(45) Date of Patent: Aug. 7, 2007

(54) BOWL MILL FOR A COAL PULVERIZER WITH AN AIR MILL FOR PRIMARY ENTRY OF AIR

(75) Inventors: Siddhartha Biswas, Calcutta (IN); Krishnamuty Venkataramani, Secunderabad (IN)

(73) Assignee: Bharat Heavy Electricals Ltd., New Delhi (IN)

( * ) Notice: Subject to any disclaimer, the term of this patent is extended or adjusted under 35 U.S.C. 154(b) by 252 days.

(21) Appl. No.: 10/822,780

(22) Filed: Apr. 13, 2004

(65) Prior Publication Data

US 2004/0227024 A1 Nov. 18, 2004

(30) Foreign Application Priority Data

May 13, 2003 (IN) ..... 694/03

(51) Int. Cl.
*B02C 15/00* (2006.01)

(52) U.S. Cl. ..... 241/119; 241/117; 241/118; 241/120; 241/121

(58) Field of Classification Search ..... 241/117, 241/118, 119, 120, 121
See application file for complete search history.

(56) References Cited

U.S. PATENT DOCUMENTS 2,378,681 A 6/1945 Bailey et al.
2,545,254 A 3/1951 Bice
2,909,330 A * 10/1959 Hardinge ..... 241/19
3,465,971 A 9/1969 Dantenberg et al.
4,002,299 A 1/1977 Skalka
4,084,754 A * 4/1978 Brundiek ..... 241/52
4,264,041 A 4/1981 Kitto et al.
4,523,721 A 6/1985 Maliszewski et al.
4,687,145 A 8/1987 Dougan et al.
4,705,223 A * 11/1987 Dibowski et al. ..... 241/117
5,020,734 A 6/1991 Novotny et al.
5,263,655 A 11/1993 Giammaruti et al.
5,522,768 A * 6/1996 Brodt et al. ..... 454/234

* cited by examiner

*Primary Examiner*—Derris H. Banks
*Assistant Examiner*—Jason Y Pahng
(74) *Attorney, Agent, or Firm*—Venable LLP; Catherine M. Voorhees

(57) ABSTRACT

A bowl mill for a coal pulverizer with an air mill for primary entry of air, comprising a substantially closed separator body (2) having a central axis; and a bowl-like grinding table (3) mounted on a shaft (4) rotatable about said central axis, cooperating with a plurality of grinding rolls (6). The airmill is provided with multiple entry openings (17', 17"; 18', 18"; 21, 25) on the outer wall of the air mill for multiple entry of hot primary air from the inlets, resulting in better uniformity in air flow around the air mill section and for minimizing formation of eddies and vortices As a variation of the multiple entry double entry openings can be arranged for entry of hot primary air.

3 Claims, 5 Drawing Sheets

BOWL MILL FOR A COAL PULVERIZER WITH AN AIR MILL FOR PRIMARY ENTRY OF AIR

FIELD OF INVENTION

The present invention relates to a bowl mill for a coal pulverizer with an air mill for primary entry of air and in particular to a new and useful design for the passage for primary air on to the bowl throat area of such pulverizers for improved velocity distribution characteristics.

BACKGROUND OF INVENTION

A variety of equipment are known suitable for grinding, i.e. pulverization of material like coal, lignite, cement etc. For the pulverization of coal used in boilers of thermal power plants, a limited number of such equipment are commonly used. For the purpose of discussion that follows, a coal fired system mainly consists of a coal feeder, equipment for pulverizing coal, a distribution system for distributing the coal after the pulverization thereof, a furnace in which the coal is to be burned, and the requisite controls for effecting the proper operation of the coal fired generation system. The equipment for pulverization of coal is of particular interest here. The coal pulverizing equipment are known to exist in prior art for more than sixty years. Many improvements in the construction and/or mode of operation of these equipment have been made during this period.

The coal pulverizing equipment is chosen based on the advantages it offers in terms of reliability, low power consumption, minimum maintenance, a wide range of capacity, low rate of wear of the replacable grinding elements used with uniform throughput of the required range of pulverized coal fines during their useful life. In addition, it should have an integrated lubrication system, convenient adjustment and control of coal flow and fineness, ability to handle high temperature air that is required for moisture coal and quiet operation.

Bowl mill is one such equipment which is commonly used in fossil fired boilers of thermal power plant, which has the above mentioned features to different desirable degrees. The name is obviously derived from the fact that the pulverization takes place on a grinding surface which resembles a bowl. Reference can be made to U.S. Pat. No. 3,465,971 (1969) and/or U.S. Pat. No. 4,002,299 (1977) which give the nature of construction and the mode of operation of a prior art form of bowl mill that is suitable for use in a coal fired power generation system for the pulverization of the coal.

Coal fired boilers used in thermal power plants require majority of the pulverised coal in a fineness range around 75 microns size for efficient combustion. Various types of pulverisers are employed in Thermal Power Stations. Raymond Bowl mill is one commonly used pulveriser for this purpose. The main components of a bowl mill consists of a cylindrical body, usually known as separator body, within which a conical bowl like grinding table is mounted for rotation, three equally spaced grinding rollers in the shape of inverted frustum of a cone are mounted so as to interact with the rotating bowl to grind the coal lumps fed on to the centre of the bowl into fine powder like form. Three rollers are mounted on to inclined stationary axis journal shafts by berings so that the roll surface is aligned with the bowl surface and are able to rotate about the axis by the friction force derived from the rotating bowel. Preselected force can be applied between the bowl and the roll surface by means of spring or hydraulic arrangement to assist grinding. The ground particles are thrown out of the bowl by centrifugal force derived from rotation of the bowl.

The hot primary air stream enters the mill from bottom of the mill known as air mill or air inlet housing, usually in horizontal direction through a single entry of rectangular cross section, such that entry air velocity is tangential, in the horizontal plane, to the annular space of-the air mill. The hot primary air moves into the annular space which is the low velocity air plenum in the air mill, and is then accelerated and oriented by a series of stationary or rotating passages in a ring that surrounds that grinding zone. These arrangements for directing the primary air through narrow annular area between the bowl rim and the housing are known as stationary or rotating vane wheel depending on their kinematic disposition. There are many relevant patents on the subject of vane wheel in which it is claimed that the vane wheel arrangement directs the air stream upward through the annular passage between the bowl rim and the housing in an efficient manner. U.S. Pat. No. 4,264,041 (year 1981) titled "Low Pressure Drop Pulverizer Throat", describes a new and improved design of pulverizer air throat for low pressure drop, reduced erosion and improved flow distribution. U.S. Pat. No. 4,523,721 (year 1985) titled "Bowl Mill with Primary Classifier Assembly", describes a rotating vane wheel arrangement for change in the direction of flow, counter clockwise to the direction of rotation of the grinding table which is helpful for primary classification of coarser coal particles. U.S. Pat. No. 4,687,145 (year 1987) titled "Roll and Race Pulverizer with rotating throat" summarises the invention as a roll and race pulverizer in which the throat vanes are mounted for rotation in the direction of rotation of the grinding ring. The rotating vanes are claimed to be spreading the ground coal spilling on to the throat area. There are other patents like U.S. Pat. No. 5,18,404(year 1983), U.S. Pat. No. 5,020,734 (year 1991), U.S. Pat. No. 2,378,681 (year 1945), U.S. Pat. No. 2,545,254 (year 1951), on the subject. In the U.S. Pat. No. 5,263,655 (year 1993) titled Coal Pulverizer an improved annular passage arrangement for pulverizer has been advocated to reduce the pressure drop across the vane wheel and also thereby to provide means of directing passage outlet airflow away from the grinding table. It is also claimed to be improving the distribution of air velocity across the annular passage.

At the outlet of the passage near the bowl rim, the pulverized coal particles are entrained by high speed air flow. The heavier coal, stone or quartz particles fall down through the annular space between the bowl and the body on to the mill base as rejects.

The velocity of air is reduced above the bowl rim area in the main pulverizer housing causing the larger particles to be returned directly to the grinding zone for further crushing, while the smaller particles are carried up through the classifier for final sizing. The moisture present in the ground coal particles are also dried in the process of association with hot air. The ground coal particles carried to classifier, get classified and the lighter particles of desired fineness go to the different elevation of the boiler through four outlet ports and the heavier particles fall back on to bowl for further regrinding continuing the cycle of pulverization.

U.S. Pat. No. 3,465,971 issued in 1969 titled "Deflector Arrangement for Use in a Grinding Mill", disclosed construction of a deflector for directing the air borne pulverized material leaving the grinding ring downwardly and inwardly back for better primary classification. In this patent the entry of primary air in the air mill is through a single inlet. This type of bowl mills known as Raymond Bowl Mill, have single entry of primary air.

In actual operation of this type of mills, the drawbacks encountered are dissimilar wear on the three rolls, high rate of rejects and non uniform output from the outlet ports. These drawbacks are suspected to be due to non uniform air flow inside the mill and also inadequate air velocity in certain areas inside the mill. It is also found that the clinker formation in the airmill are due to formation of eddies and vortices in the air mill.

Analytical studies using computational fluid flow software package reveals that the distribution of airflow in the air mill section is not uniform around the periphery. It is seen in such a study that with single entry of primary air into the mill only about 60 percent of the total cross sectional area has high velocity. Further away from the inlet, the velocity of air loses its magnitude to very low value compared to the velocity at the entry region. This essentially means that in about 40 percent of peripheral area of the bowl, the coal particles will not be lifted with desired velocity and will result in falling back on the bowl for regrinding Another effect could be heavy rates of rejects containing coal lumps and other particles through that part of the throat area where the vertical velocity component of air is less. Such a study also shows the presence of considerable eddies and vortices, specially in the last quadrant of the air mill section from the entry.

The purpose of introducing rotating vane wheel in some of the patents described in earlier paragraphs appears to be to remove the deficiency of the non-uniform distribution of air velocity around the bowl rim coming from the air mill. This is attempted by spreading the incoming air and also the falling pulverized coal, which is possible only to a limited extent by the rotating vanes attached to the bowl. This effect can only be very localized as the fanning action can not bring about a high degree of uniformity where the peripheral velocity of the bowl is much less compared to the average vertical velocity of the primary air near the bowl rim.

Considerable improvement in primary classification is possible by uniform flow distribution reducing regrinding. Similarly minimization of eddies and vortices will lead to cutting down energy losses and also avoid accumulation of inflammable rejects which lead to clinker formation.

It is, therefore, an object of the present invention to achieve much better uniformity in airflow around the air mill section of a bowl mill of a coal pulverizer, for having uniform output from the outlet ports and for avoiding dissimilar wear on the rolls.

Another object of the present invention is to minimize the eddies and vortices formed by the non uniformity of flow for avoiding clinker formation.

Yet another object of the present invention is to reduce the amount of undesirable rejects from the mill.

A still further object of the present invention to reduce the overall energy consumption and make the mill operation more efficient.

SUMMARY OF THE INVENTION

These objects are achieved in the present invention by providing a multiple entry system for primary air for uniform velocity distribution throughout the periphery of the bowl rim and transportation of ground coal of the classifier.

In the prior art design the primary air meant for transporting ground coal, does not have uniform distribution through out the periphery of the bowl rim. In the present invention, the uniformity of velocity distribution around the periphery of the bowl rim is achieved by providing multiple entry of the primary air into the air mill section from where the air changes its direction to transport the ground coal upwards from the bowl rim. The number of entries starting with double entry (including single entry bifurcation) results into a much better distribution of air velocity for transportation of ground coal from the bowl rim to the classifier compared to that with single entry.

Thus the present invention provides a bowl mill for a coal pulverizer with an air mill for primary entry of air, comprising a substantially closed separator body having a central axis; and a bowl-like grinding table mounted on a shaft rotatable about said central axis, cooperating with a plurality of grinding rolls; characterized in that said air mill is provided with multiple entry annular openings on the outer wall of said air mill for multiple entry of hot primary air from the inlets, resulting in better uniformity in air flow around the air mill section and for minimizing formation of eddies and vortices.

In the present invention, the area for inlet of air into the air mill is maintained but the number of inlets is increased to provide more uniform energy input sectorially through the multiple inlets compared to the prior art design. The proposed layouts for each of the multiple entry configuration can have different cross sections like rectangles of different width and height in line with cost consideration, existing ducting, layout problems, flow considerations etc. According to present invention as a particular case of multiple entry, two separate ductings with one entry each placed nearly 180° apart has been proposed. Two variations have been given. In the first one, the height of the annular air entry opening has been reduced to half, while in the second embodiment both height and width have been reduced keeping the area of individual entry, half of that of a single entry design. The computational fluid flow analysis has shown improvement in velocity distribution across the circumference compared to the prior art arrangement. However, the first of the two arrangements proposed show less eddies.

In another embodiment of the present invention an alternate arrangement for air entry is provided, which is suitable for cases where multiple entry with separate ducting is not feasible due to cost limitation, or layout limitations or both. In such a case, the total area is divided into two sections at the inlet by providing partition wall in the flow path such that the flow in each section is in the ratio of around half the original flow taking into the flow losses. The half section at inlet adjacent to the annular space in the air mill below the bowl, directs the air flow through that section tangentially into the air mill for providing sufficient velocity for lifting of coal particles, up to first half of the circumference in that plane and the other half of the bifurcated primary air has sufficient energy to provide sufficient vertical velocity in the other half of the circumference of throat area. The various features of novelty which characterize the invention are pointed out with particularity in the detailed description which follows forming part of this disclosure. For a better understanding of the invention, its operating advantages and specific objects attained by its uses, reference is made to the accompanying drawing and descriptive matter in which the preferred embodiments of the invention are illustrated.

DESCRIPTION OF A PREFERRED EMBODIMENT

Figure 1:
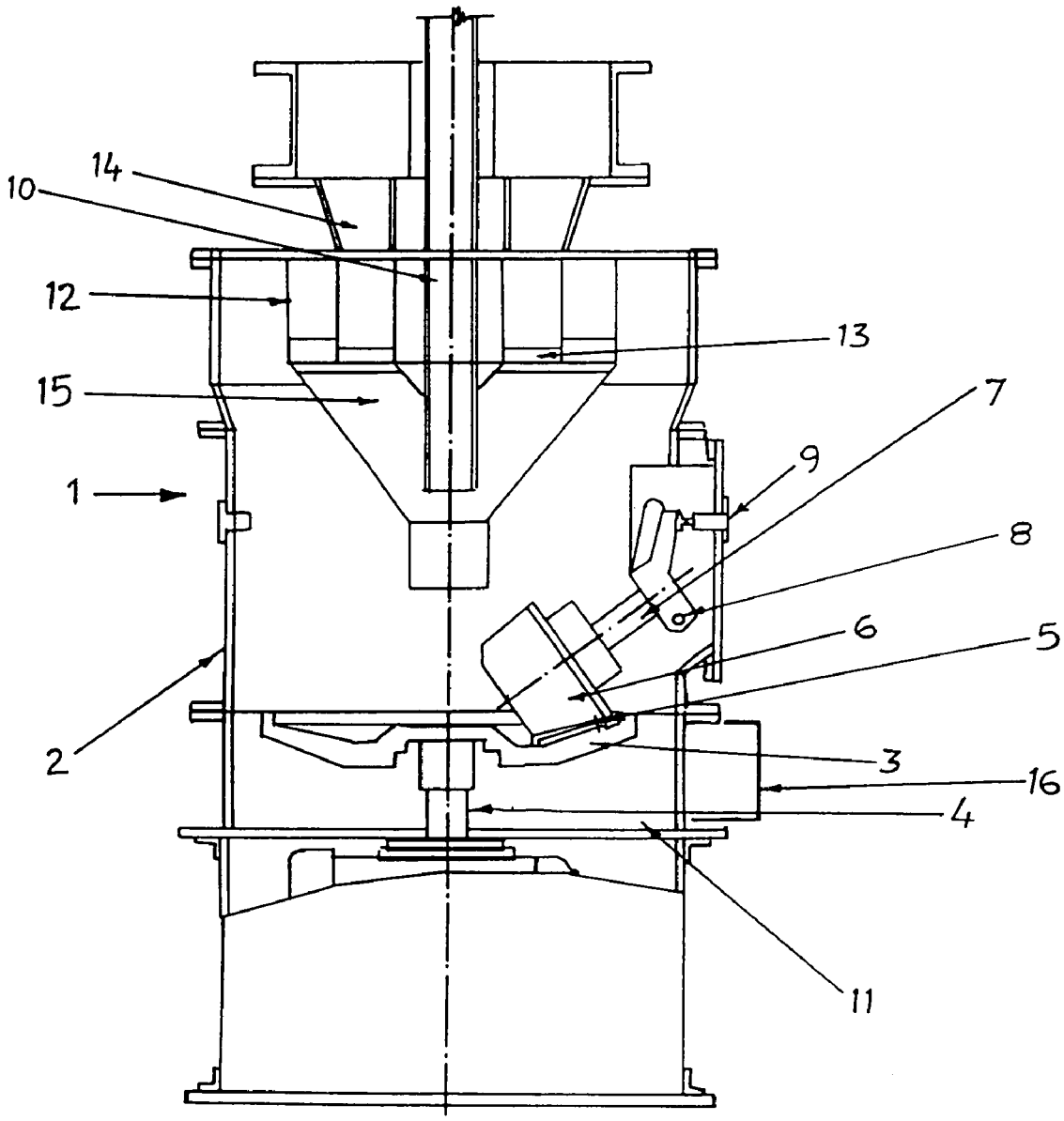
FIG. 1 Side elevational view partly in section and with some parts broken away of a bowl mill in which the present invention can be applied.

Referring now to the drawing, and more particularly FIG. 1 shows a schematic diagram of the essential components of a bowl mill required for describing the nature of construction and the mode of operation of a bowl mill, generally designated by reference numeral 1, specially with reference to the multiple entry of primary air developed in the present invention. The description of details of various parts and the working of the bowl mill will be given here only to the extent relevant for explaining the working of the air mill of the present invention.

FIG. 1 shows a substantially closed separator body 2, which encloses the grinding zone of pulverisation. A bowl like grinding table 3 is mounted on a shaft 4, which in turn is connected to a drive machines(not shown) which can rotate the table at the desired speed. A set of replacable wear part called bull ring segments 5 made of hard abrasive resistant material are placed on the bowl to co-act with the grinding roll 6. A plurality of grinding rolls 6, preferably three in number are suitably supported within the interior of the separator body 2 so as to be spaced equidistantly one from another around the circumference of the latter. Each roll is suitably supported on a suitable shaft 7 for rotation relative thereto. Additionally the roll shaft assembly can move in the vertical plane by rotation of the shaft assembly about the trunion shaft B which is in turn suitably mounted in the separator body 2. The vertical movement of the roll is restricted by application of force by a spring mounted in a spring housing assembly 9. The spring is used to exert the requisite amount of force through the grinding roll on to the material, e.g. coal that is disposed on the grinding table. The material to be ground such as coal lumps of specified size range are fed through the vertical feed pipe 10 on to the centre of the rotating bowl. Under the action of centrifugal force the coal lumps move radially outward with respect to the bowl. Being simultaneously under rotating motion along with the bowl, these coal lumps as a part of a moving coal bed has to pass through the roll and bull ring segments on the bowl. The gap between roll and the bowl being less than the coal bed height, the coal lumps in the bed get pulverised between the roll and the bull ring segments by attrition and also direct coaction. The spring force adds to the weight of the roll assembly to crush the coal. The coal particles of various sizes flow out of bowl rim as they reach it. Pressurized hot primary air coming through the air mill housing (11) and flowing upward passes between the bowl rim and the separator body at a high velocity to carry the coal particles upward towards the classifier inlet (12). The particles or lumps of the ground material, which can not be lifted from the edge of the bowl by the primary air fall down through the gap between the bowl rim and the separator body on to the air mill bottom as reject. The reject gets out of the system through discharge hopper (not shown). The nature and the construction of the air mill housing (11) comprise the subject matter that forms the essence of the present invention. Heavy coal particles in the upward stream of air/coal mixture which are not supported by the air velocity fall back on the bowl before reaching the classifier inlet (12). In the classifier (13), the finer particles are required for proper combustion in the boiler goes out through the outlet port (14) and the heavier undesired particles fall back on the bowl through the cone (15) and get mixed with the incoming coal lumps.

Figure 2:
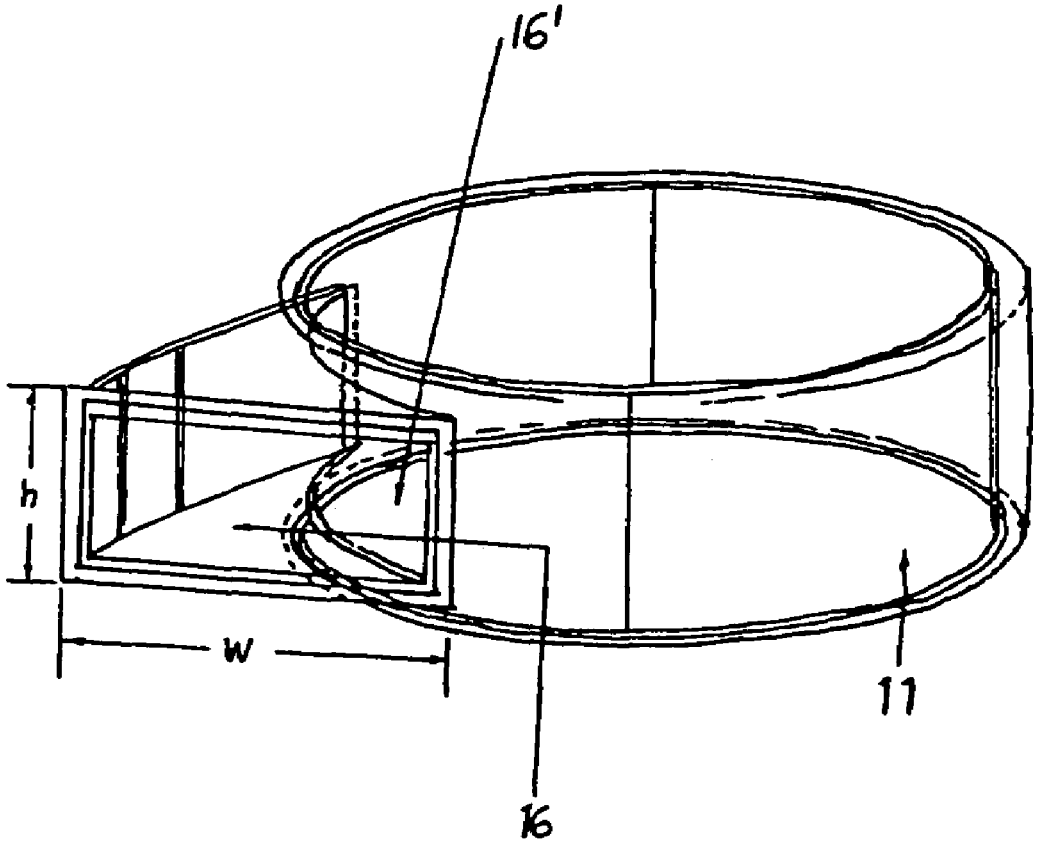
Fig. 2 PRIOR ART
FIG. 2 Line diagram air mill with the prior art configuration of single entry for primary air.

Turning now to the role of air mill in achieving the desirable features of a pulverizer described earlier, reference will be made for this purpose particularly to FIGS. 2 to 5 of the drawing. In the prior art, the hot primary air enters the air mill housing through a rectangular inlet opening (16) as shown in FIGS. 1 and 2. The entry velocity of air is in the horizontal direction to flow into the annular opening 16' between the air mill outer circumferential wall and the inner circumferential wall below the grinding table (3). In this low velocity plenum, the air velocity changes direction towards vertical to flow through the narrow annular gap between the bowl (3) rim and the separator body (2) for conveyance of the coal from the grinding table (3). The circular annular gap is also called the throat.

The stream of air flowing out of the throat area with coal particles entrained therein follow a tortuous path through the interior of the separator body. Moreover, in the course of following the tortuous path the larger of the coal particles are caused to be separated from the air stream in which they are entrained and made to return to the surface of the grinding table (3) whereupon they undergo pulverization. This process is called primary classification. The lighter of the coal particles, on the other hand, continue to be carried along the air stream to the classifier inlet (12).

Separator body liner with static vanes (U.S. Pat. No. 4,234,132 dt. Nov. 18, 1980) or rotating vane wheels (U.S. Pat. No. 4,602,745, dt. Jul. 29, 1986) are employed in bowl mill for the purpose of primary classification. These devices provide a direction to the upcoming air from the air mill for better primary classification. The rotating vane wheel additionally enables localized spreading of the upcoming primary air due its rotation. This spreading is preferred to lessen the deficiency of non uniformity of velocity distribution of the upcoming primary air. However, due to its localized effect, it is effective in a very limited way.

With the entry of air from a single inlet, the velocity of the upcoming primary air through the throat area decreases continuously with distance from entry as it travels around the air mill housing. So much so that by the time it travels, may be more than 270° around the air mill from the entry, it attains a very low velocity, insufficient for lifting of the pulverized coal particles thrown out of the grinding table by centrifugal action. This results into increase in the undesirable rejects, improper primary classification and non uniformity of the flow around the separator body onto the classifier and finally to the outlet ports. The single entry of the primary air also produces eddies and vortices in the air mill resulting into accumulation of coal particles on the base of the air mill to form clinkers which very often cause fire in the mill. These problems are encountered in the mills operating with prior art design with single entry of primary air.

These observations tally with actual problems in field. The air flow in the bowl mill has been studied analytically using commercially available computational fluid flow package.

The results of those studies have confirmed the validity of above observations. As an example, the velocity distribution in a horizontal plane in the air mill shows gradual decrease of velocity of air as it travels away from the entry and as also the formation of vortices and eddies.

Figure 3A:
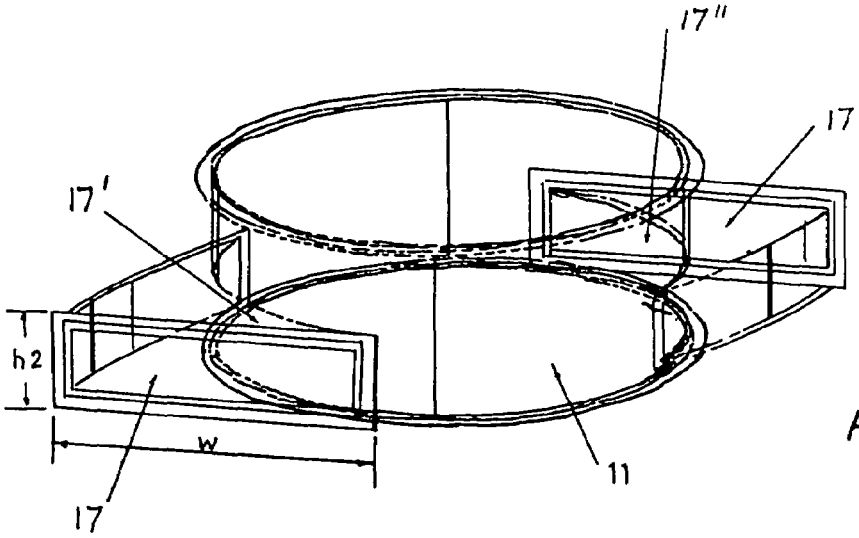
FIG. 3*a* Line diagram representation of air mill with multiple entry for primary air according to one embodiment of the present invention.
Figure 3B:
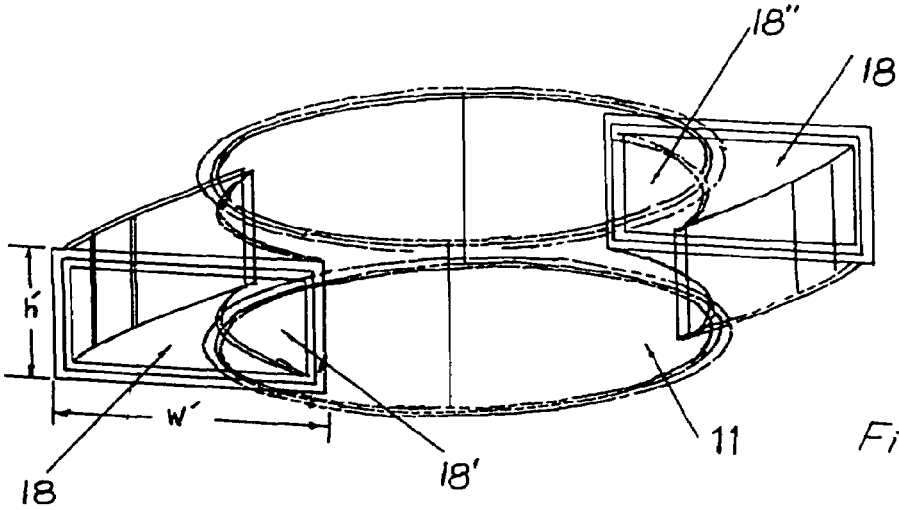
FIG. 3*b* Line diagram for another embodiment of the airmill.
Figure 4A:
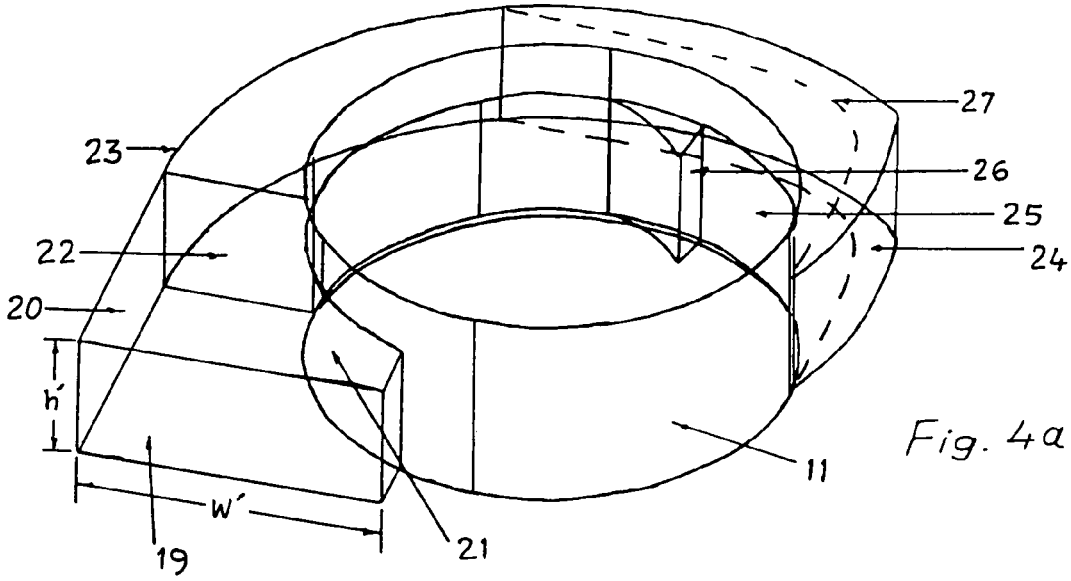
FIG. 4*a* Line diagram air mill accompanying to another embodiment with uniform cross section of the circumferential ducting and alternate arrangement for gradual reduction of cross sectional area shown in dotted line.
Figure 4B:
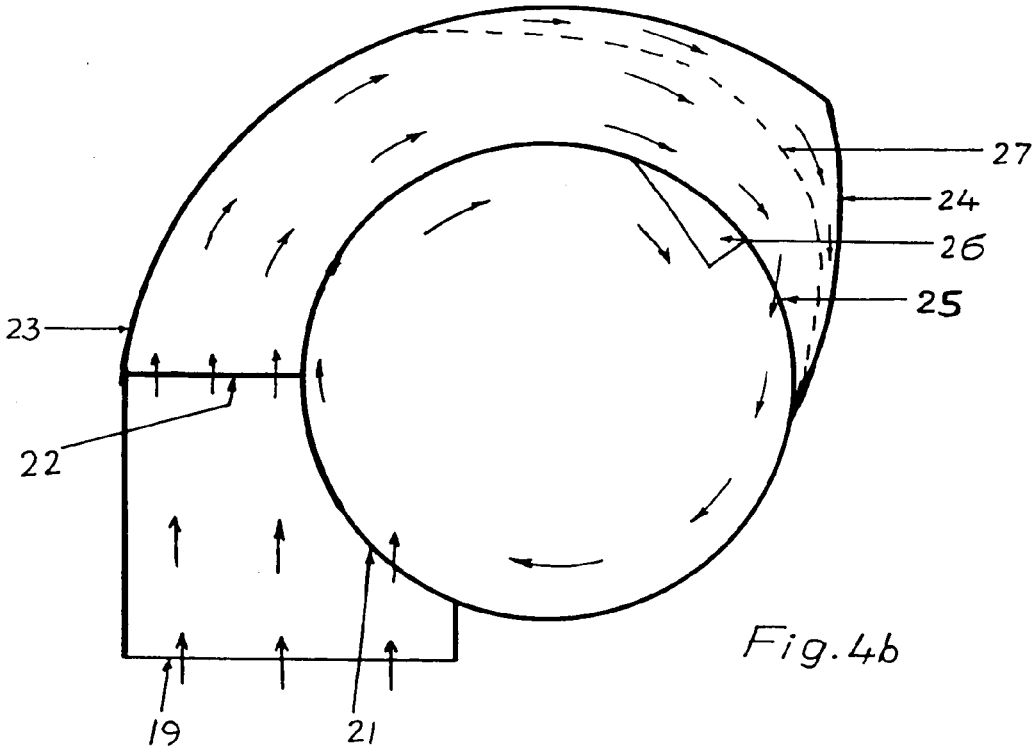
FIG. 4*b* Outline plan view of the airmill arrangement shown in FIG. 4*a*, showing the direction of airflow schematically.

To overcome the above deficiencies in the prior art by making the velocity distribution uniform all around the throat area, a multiple entry of primary air into the air mill is proposed instead of single entry. Two preferred embodiments of multiple entry are shown in FIGS. 3*a* and 3*b*. Although more number of entries will achieve successively better velocity distribution around the throat area but limitation will come from the point of view of layout and cost. In the double entry configuration, each entry area is kept half of the original area of the single entry so as not to alter the inlet velocities. In the double inlet ducting configuration two variations are possible. The first variation is shown in FIG. 3*a* where the height of the annular openings 17' and 17" is reduced by half. In the second variation shown in FIG. 3*b*, in each of the openings 18' and 18", both the height and the width are altered keeping the area of each entry approximately half of the original entry area of single entry system. The multi entry openings 17', 17" and 18', 18" are set 180° apart.

Where it is not possible to have more than one duct for primary air into the air mill due to constraints in layout or cost, an alternative arrangement is proposed in this invention. Reference is made to the FIGS. 4*a* and 4*b* showing the line diagram and plan outline view of the air mill (11) with single inlet (19) with bifurcation of the primary air at inlet. The novelty of this arrangement is that the primary air through the single inlet (19) and the duct (20) is bifurcated. About half of the incoming primary air enters the airmill through a first opening (21) provided on the outer wall of the air mill (11). The other half gets channelized into the duct (23) through the opening (22). The duct (23) is extended around the airmill till the second opening (25) to enter the airmill at about 180° from the first opening (21) around the central vertical axis of the mill. The duct (23) terminates at end wall (24) on the outside. The cross section of the duct (23) is constant through out. A blockage (26) is put before the opening (25) such that the primary air flowing in the air mill from the first entry (21) does not create turbulence while mixing with air coming from opening (25). If the velocity of air at inlet (19) is not high enough, the velocity of air at opening (25) may drop down due to flow resistance in the duct (23) to a value not suitable for lifting of coal particles at the throat area up to the end of the half, it is supposed to cover. For such cases, it is proposed that the cross section of the duct (23) is gradually decreased to (27) in FIG. 4*a* and 4*b*, such that the velocity of air entering the airmill is through opening (25) is high enough for the purpose of lifting the pulverized coal particles.

Figure 5A:
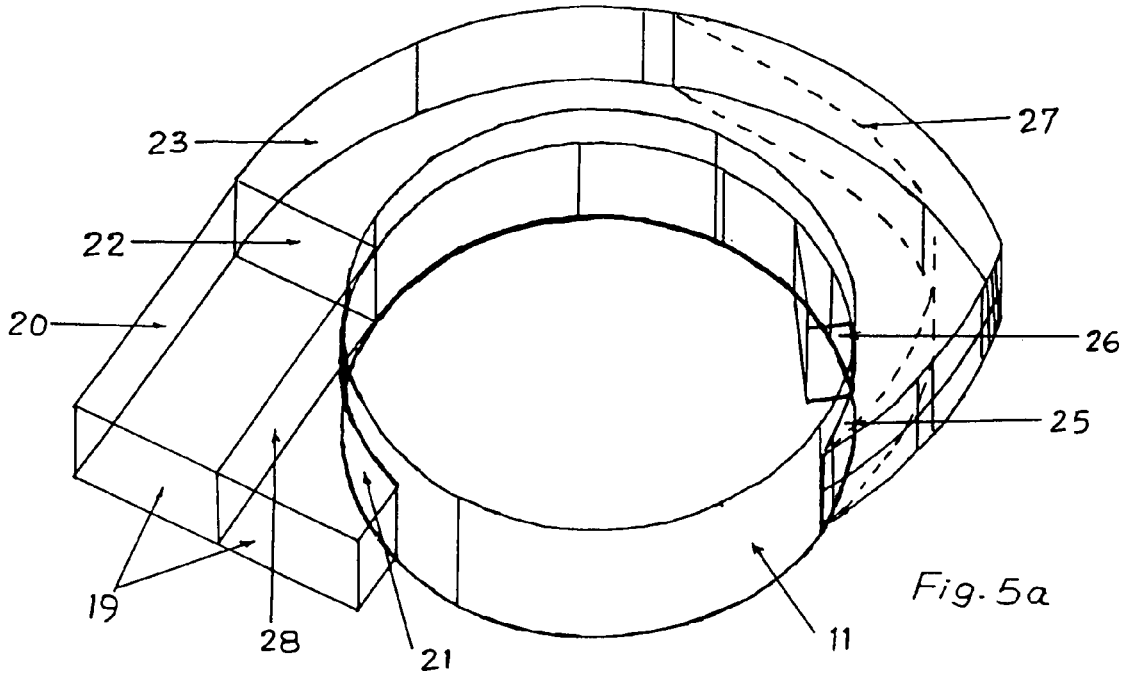
FIG. 5*a* Line diagram of the airmill according to another embodiment with partition at the inlet.
Figure 5B:
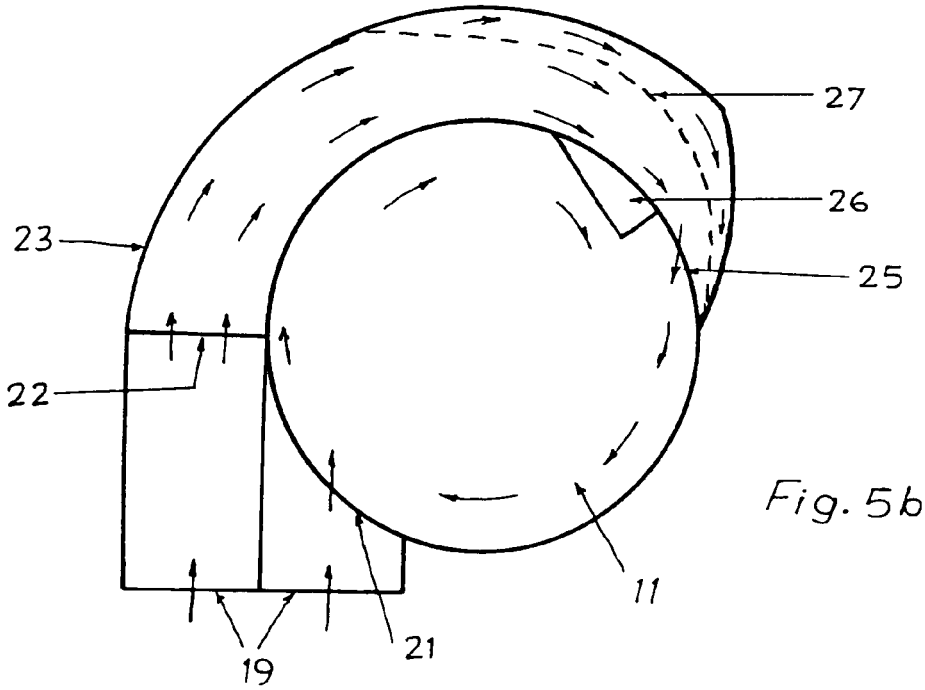
FIG. 5*b* Outline plan view of the air mill show in FIG. 5*a*.

An alternative arrangement for bifurcation of primary air is further proposed in FIGS. 5*a* and 5*b*. A partition (28) is provided in the duct (20) such that the primary air is divided right at the inlet (19), one half through the first opening (21) into the airmill and the other half going through the second opening (25) into the air mill. In this arrangement also, the cross section of the peripheral duct can be reduced gradually to take care of the losses due to bend as shown by the dotted line (27).

What is claimed is:

1. A bowl mill for a coal pulverizer with an air mill for primary entry of air, comprising a substantially closed separator body (2) having a central axis; a bowl-like grinding table (3) mounted on a shaft (4) rotatable about said central axis, cooperating with a plurality of grinding rolls (6); and an air mill with an outer wall disposed under the bowl-like grinding table characterized in that said air mill is provided with multiple entry annular openings on the outer wall of said air mill, resulting in better uniformity in air flow around the air mill section and minimizing formation of eddies and vortices, and further comprises an inlet (19) which is bifurcated with a partition (28) allowing half of a primary air entering inlet (19) to enter the air mill through a first opening (21) and the other half of the primary air entering inlet (19) to enter a duct (23) leading to a second opening (25) which is set 180 degrees from the first opening (21) whereby the partition splits entry of the primary air into the air mill into two streams of air.

2. The bowl mill of claim 1, wherein a blockage (26) is provided upstream of said second opening (25) so that primary air from the first opening (21) does not create turbulence so that the two streams of air to flow in the same general direction after mixing.

3. The bowl mill of claim 1, wherein the cross-section of said duct (23) is gradually decreased up to section (27).

* * * * *